US005636832A

United States Patent [19]

Honegger et al.

[11] Patent Number: 5,636,832

[45] Date of Patent: Jun. 10, 1997

[54] APPARATUS FOR FEEDING SHEET-LIKE PRODUCTS TO A DISCHARGE LOCATION

[75] Inventors: Werner Honegger, Tann-Ruti; Kurt Bohli, Tann, both of Switzerland

[73] Assignee: Ferag AG, Switzerland

[21] Appl. No.: 409,799

[22] Filed: Mar. 23, 1995

[30] Foreign Application Priority Data

Mar. 24, 1994 [CH] Switzerland ..... 00886/94

[51] Int. Cl.[6] ..... B65H 5/22; B65H 5/02; B65H 29/66

[52] U.S. Cl. ..... 271/3.21; 271/4.06; 271/10.07; 271/35; 271/274; 271/186; 271/198; 271/314; 271/216

[58] Field of Search ..... 271/4.06, 184–186, 271/188, 198, 273, 274, 314, 216, 3.21, 10.07, 34, 35

[56] References Cited

U.S. PATENT DOCUMENTS

| | | | |
|---|---|---|---|
| 2,589,428 | 3/1952 | Pearce . | |
| 2,787,468 | 4/1957 | Novick | 271/314 X |
| 2,933,313 | 4/1960 | Stobb | 271/185 |
| 3,140,089 | 7/1964 | Greenblott et al. | 271/185 X |
| 3,188,082 | 6/1965 | Stabb | 271/185 X |
| 3,522,943 | 8/1970 | Swanson | 271/216 X |
| 3,591,171 | 7/1971 | Schmidt | 271/188 X |
| 3,635,463 | 1/1972 | Stobb | 271/185 X |
| 3,659,699 | 5/1972 | Donahue et al. | 271/86 X |
| 4,026,550 | 5/1977 | Klenk . | |
| 4,034,845 | 7/1977 | Honegger | 271/185 X |
| 4,279,412 | 7/1981 | Glatz . | |
| 4,369,959 | 1/1983 | Hornbuckle . | |
| 4,463,940 | 8/1984 | Mock | 271/314 X |
| 4,478,400 | 10/1984 | Commers . | |
| 4,718,656 | 1/1988 | Reist . | |
| 4,762,314 | 8/1988 | Harada . | |
| 5,042,792 | 8/1991 | Honegger et al. . | |
| 5,275,685 | 1/1994 | Stauber . | |
| 5,350,167 | 9/1994 | Hansch . | |
| 5,377,967 | 1/1995 | Eberle . | |

FOREIGN PATENT DOCUMENTS

| | | | |
|---|---|---|---|
| 578685 | 6/1959 | Canada | 271/186 |
| 0551601 | 11/1992 | European Pat. Off. . | |
| 609686 | 8/1994 | European Pat. Off. | 271/198 |
| 3347147 | 9/1994 | Germany . | |

*Primary Examiner*—Boris Milef
*Attorney, Agent, or Firm*—Brinks Hofer Gilson & Lione

[57] ABSTRACT

A conveying belt is deflected around a stationary deflection roller and loops around the bottom of a deflection wheel. The deflection wheel is freely rotatably mounted on a lever and is prestressed in the direction towards the deflection roller by a spring element. The conveying belt, driven by a stepping motor, and the deflection wheel form a conveying gap for the products, which are arranged in an imbricated formation. In this formation each product, as seen in the feed direction, bears on the preceding product, with almost complete overlapping. The products form a stack-like supply and are conveyed to the discharge location, with the result that a product is always available there for discharge.

15 Claims, 3 Drawing Sheets

APPARATUS FOR FEEDING SHEET-LIKE PRODUCTS TO A DISCHARGE LOCATION

BACKGROUND OF THE INVENTION

The present invention relates generally to an apparatus for the uninterrupted feeding of sheet-like products to a discharge location.

U.S. Pat. No. 2,589,428 discloses a device for collating sheet-like products by means of a collating conveyor. The collating conveyor includes controllable grippers arranged on a chain which is driven in circulation. Arranged one behind the other beneath the collating conveyor are a plurality of apparatuses for the uninterrupted feeding of the products to the discharge locations. At the discharge locations the uppermost product of a stack-like supply is raised by a suction element and fed to a gripper. In order to receive the supply, each apparatus includes a stack shaft which is inclined forwards, with respect to the vertical, in the conveying direction of the collating conveyor. The shaft includes a front stack wall provided with a supporting strip against which the products butt by means of one of their edges. Additionally, the stack-like supply bears on a raisable and lowerable shaft base. The shaft base is controlled such that the uppermost product of the supply is located respectively at the discharge location. In order to ensure uninterrupted feeding of the products, each stack shaft is assigned a second shaft base which, alternately with the first-mentioned shaft base, raises the supply stack to the discharge location and receives a replacement stack and raises the latter from beneath up to the supply stack. As a result, the shaft base bearing the supply stack can be moved out of the stack shaft in order to receive a new replacement stack. The construction and control means of this apparatus is high in outlay since two shaft bases have to be individually driven and controlled. Furthermore, the accessibility to the stack shaft is restricted. This constitutes a certain obstruction when introducing a replacement stack.

Therefore it is an object of the present invention to provide an apparatus for the uninterrupted feeding of sheet-like products to a discharge location.

SUMMARY OF THE INVENTION

This object and other objects are achieved by an apparatus which includes a conveying belt and a deflection wheel which form a curved stack shaft. This curved stack shaft is automatically adapted to the size of the products and, at the same time, has the effect of aligning the same. Upstream of the curvature, as seen in the feed direction, free accessibility from above is ensured. This permits simple charging. The products are arranged in imbricated formation which permits the simple formation of a stack part at the discharge location by pushing in the products from beneath. Virtually complete overlapping permits a large supply capacity with a small space requirement and gives the products a particularly good degree of stability both in the approximately horizontal part of the supply and in the curvature. Even with high processing speeds, the products are moved at a low conveying speed. This permits, for example, supplementing of the supply by depositing onto the conveying belt products, the products being tipped forwards, as seen in the feed direction, after being deposited. The low conveying speed also results in the products running smoothly into the stack part and thus prevents abrupt movements of the stack part.

In a particularly preferred embodiment of the invention, the products assume, at the discharge location, a position which is inclined approximately by 45° with respect to the vertical. This ensures, the stability of the products and, automatic alignment.

BRIEF DESCRIPTION OF THE DRAWINGS

The present invention is explained in more detail below with reference to an exemplary embodiment shown in the drawings which are in schematic form.

DETAILED DESCRIPTION OF THE PRESENTLY PREFERRED EMBODIMENTS

Figure 1:
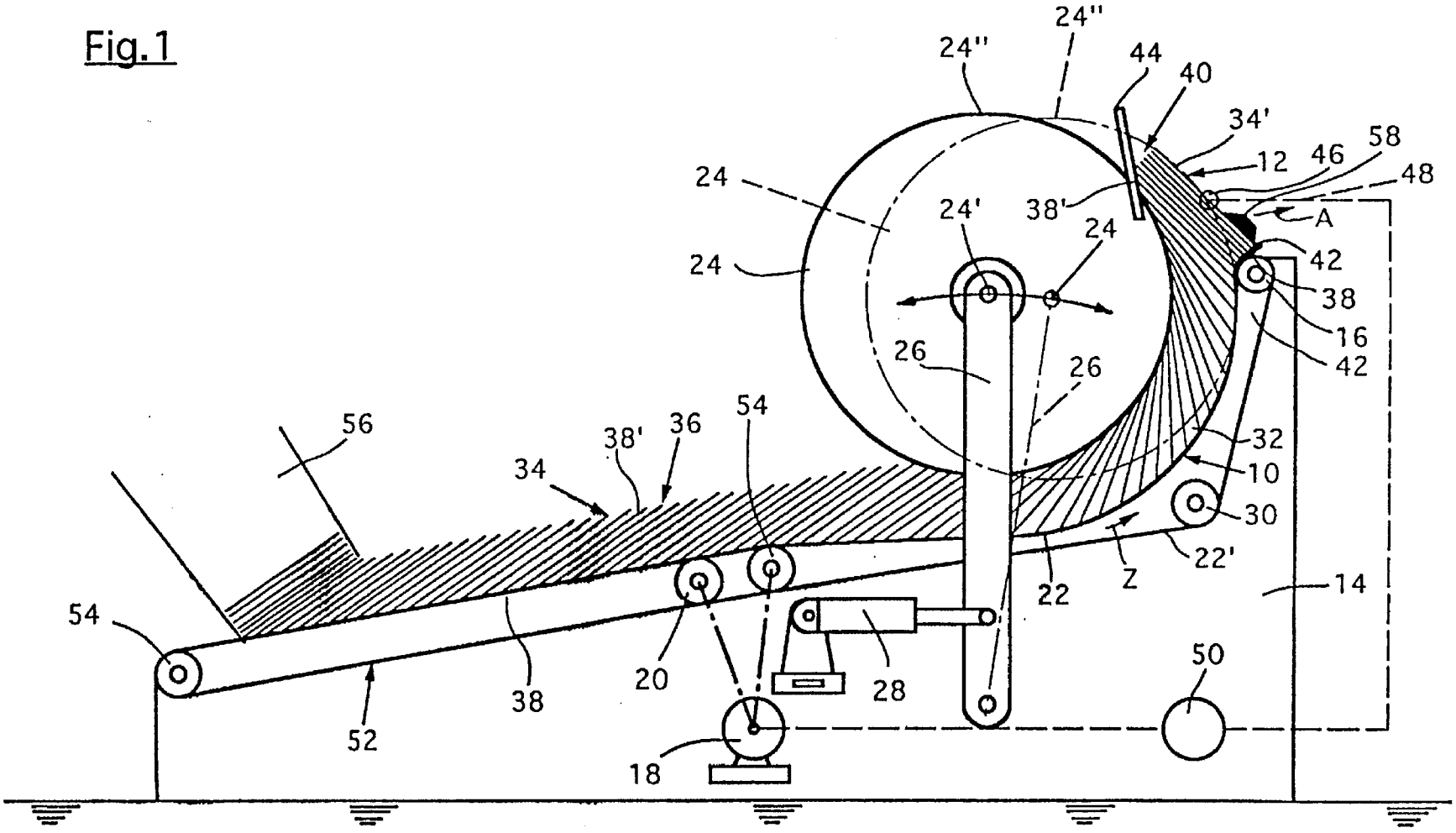
FIG. 1 shows, in elevation, a preferred embodiment of an apparatus according to the invention.

Referring now to the drawings, a continuous conveying belt 10 is guided, at a discharge location 12, about a deflection roller 16. The deflection roller 16 is mounted freely rotatably on a framework 14 on an axis which runs in the horizontal direction. On the framework 14 there is further mounted a drive roller 20 which is connected to a controlled drive, such as a stepping motor 18. The drive roller 20 is arranged parallel to the deflection roller 16 and, with respect to the latter, is arranged at lower level, in the vertical direction, and offset perpendicular with respect to horizontal direction. An active strand 22 of the conveyor belt 10, extends between the drive roller 20 and deflection roller 16. The active strand 22 loops around the bottom of a deflection wheel 24 which is mounted freely rotatably at the free end of the lever 26. The other end of the lever 26 is pivotably articulated on the framework 14, beneath the active strand 22. The lever 26 and thus the deflection wheel 24 are prestressed in the direction towards the deflection roller 16 by a spring element 28, preferably a pneumatic spring. The diameter of the deflection wheel 24 is essentially greater than the deflection roller 16. The diameter of the deflection wheel 24 may be, for example, from 5 to 20 times greater, and preferably from approximately 8 to 12 times greater. The rotational spindle 24' of the deflection wheel 24 runs parallel to the axis of the deflection roller 16 and is located at approximately the same level as the deflection roller 16. It is preferably located beneath the deflection roller 16 by an amount which is considerably smaller than the radius of the deflection wheel 24. The highest point 24" of the deflection wheel 24 is thus located at a higher level than the deflection roller 16.

The non-active return strand 22' of the conveying belt 10 is guided, between the deflection roller 16 and the drive roller 20, around a further deflection roller 30. The further deflection roller 30 is arranged on the framework 14 such that the active strand 22 of the compliant conveying belt 10 can yield with respect to the deflection wheel 24.

A conveying gap 32 is defined between the active strand 22 and the deflection wheel 24. The gap 32 is used to feed the sheet-like products 34 to the discharge location 12. The sheet-like products may be single-leaf or multiple-leaf printed products, for example cards, supplements, magazines. The sheet-like products are introduced into a main product at a further-processing station. They may also, however, be samples of goods and the like. In particular, flexible sheet-like products are suitable.

As seen in the feed direction Z, the products 34 bear on the active strand 22 in an imbricated formation 36. In this imbricated formation each product 34 (as seen in the feed direction Z) bears on the preceding product, preferably with virtually complete overlapping. The products 34 butt against the conveying belt 10 with their trailing edge 38 (as seen in the feed direction Z). They are carried along by the conveying belt 10 by means of friction and are held in the conveying gap 32 between the active strand 22 and the deflection wheel 24. The leading edge 38' of the products 34 butt against the deflection wheel 24. As can be seen best in FIG. 2, both the conveying belt 10 and the deflection wheel 24 are essentially narrower than the products 34. By virtue of the imbricated formation, the curved conveying gap 32 and the compressire force, acting in a central region, of the conveying belt 10 and of the deflection wheel 24, the products 34 are held in an extremely stable manner. The friction between the conveying belt 10 and the products 34 and the relatively small amount of friction between the products 34 and the deflection wheel 24 as well as the possible compliance of the conveying belt 10 result in an ordered fanning-out of the products 34 in the conveying gap 32, as can be seen best in FIGS. 1 and 3.

The conveying gap 32 terminates approximately in the vertical direction. At the discharge station or location 12, this leads to the formation of a part-stack 40 with products 34. Here, the products 34 butt congruently against one another and, bear on a supporting element 42 (with their bottom, previously trailing edge 38) which is arranged at the deflection roller 16 and is supported on the framework 14. In this arrangement, the products assume a position which is inclined preferably by approximately 45° with respect to a vertical. The formation of the part-stack 40 takes place from beneath, in that products 34 are pushed in from the conveying gap 32. The uppermost product 34' of the part-stack 40 is accessible both on its exposed surface and along all the edges.

On the side of the part-stack 40 which is directed away from the supporting element 42, a strip-like removal element 44 is arranged on the framework, on each side of the deflection wheel. In every position, the periphery of the deflection wheel 24 intersects the removal element 44. This ensures that none of the products 34 are carried along by the deflection wheel 24. Seen in elevation, the removal element 44, together with the deflection wheel 24 form an obtuse angle, open towards the supporting element 42. With respect to the wheel, the removal element 44 is arranged such that, when a product 34 runs in beneath the part-stack 40, it runs onto the removal element 44 with its leading edge 38' and is raised off the deflection wheel 24. This facilitates pushing-in of the subsequent products 34 and aids the quality of the part-stack 40, in that the products 34 are displaced into abutment against the supporting element 42.

Arranged at the discharge location is a sensor element 46. The sensor element is connected, via a line 48, to a control device 50 which activates the stepping motor 18 such that the uppermost product 34' of the part-stack 40 is always located at the discharge location 12.

Provided upstream of the conveying belt 10 is a strap conveyor 52. The strap conveyor includes a plurality of endless straps which are arranged one beside the other. The straps are guided, at the beginning and at the end of the strap conveyor 52, around strap rollers 54 which are mounted in a stationary manner on the framework 14. The end region of the strap conveyor 52 overlaps the beginning region of the conveying belt 10. The strap rollers 54 on this side are connected to the stepping motor 18 in order to drive the strap conveyor 52 at approximately the same speed as the conveying belt 10. As seen in the feed direction Z, the strap conveyor 52 rises slightly. The active strand 22 of the conveying belt 10 forms essentially a rectilinear continuation of the strap conveyor 52 when there are no products 34 in the conveying gap 32 (see the position of the deflection wheel 24 which is shown in chain-dotted lines in FIGS. 1 and 3).

Arranged in the beginning region of the strap conveyor 52, above the latter, is a shaft 56 (shown schematically). The shaft 56 is inclined obliquely rearwards with respect to a vertical (as seen in feed direction Z). Stacks of products 34 may be inserted into this shaft 56, for example, by hand. From these stacks of products, when the strap conveyor 52 is in the driven state, the imbricated formation 36 is produced. As discussed above, the imbricated formation preferably has virtually complete overlapping of the products 34. It has been shown that, in this formation 36, the products 34 essentially maintain their position, i.e. that they are arranged approximately at right angles with respect to the longitudinal direction of the shaft 56. In other words, the formation 36 can be adjusted by corresponding oblique positioning of the shaft 56 with respect to the strap conveyor 52.

Figure 2:
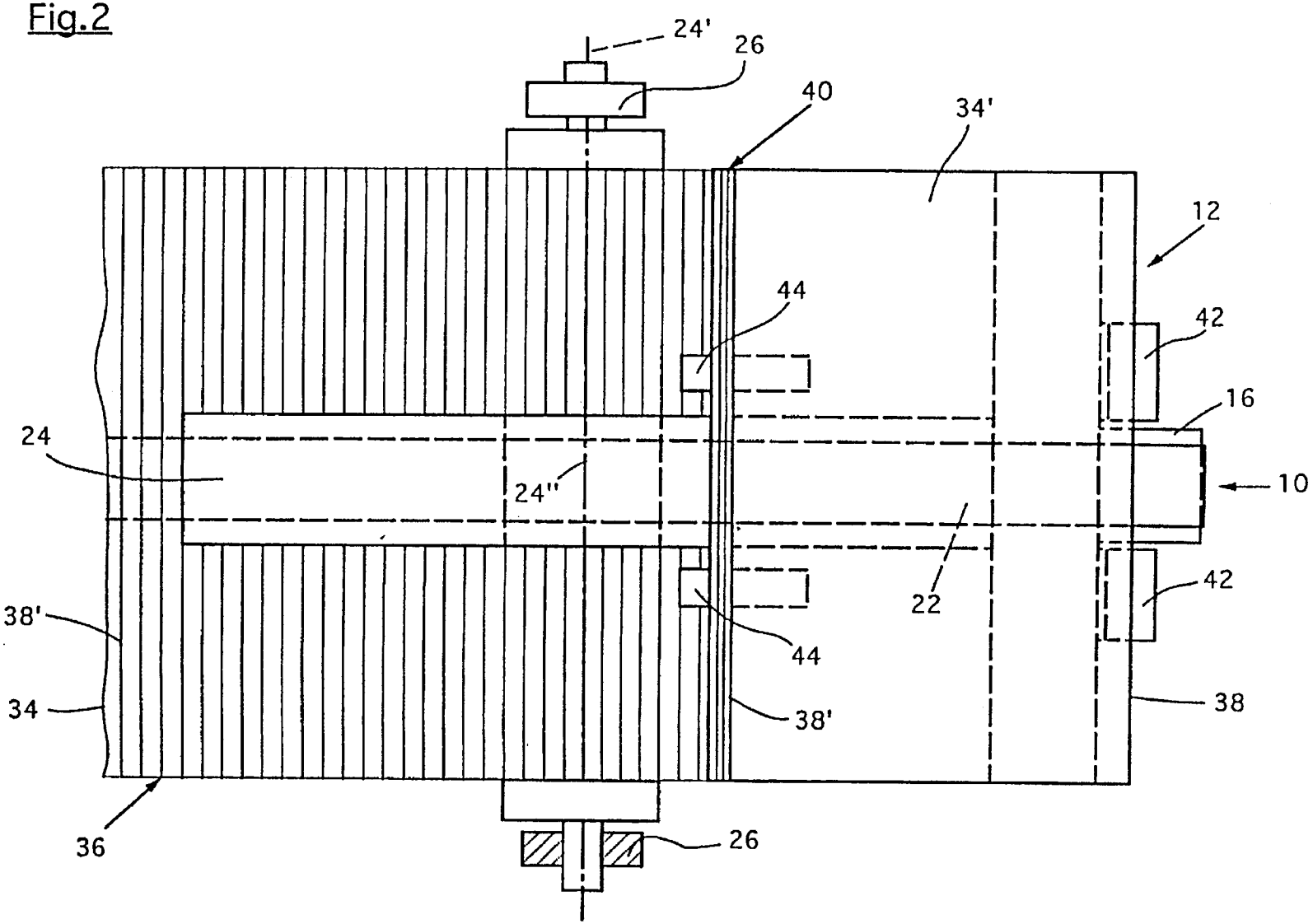
FIG. 2 shows a plan view of part of the apparatus shown in FIG. 1.
Figure 3:
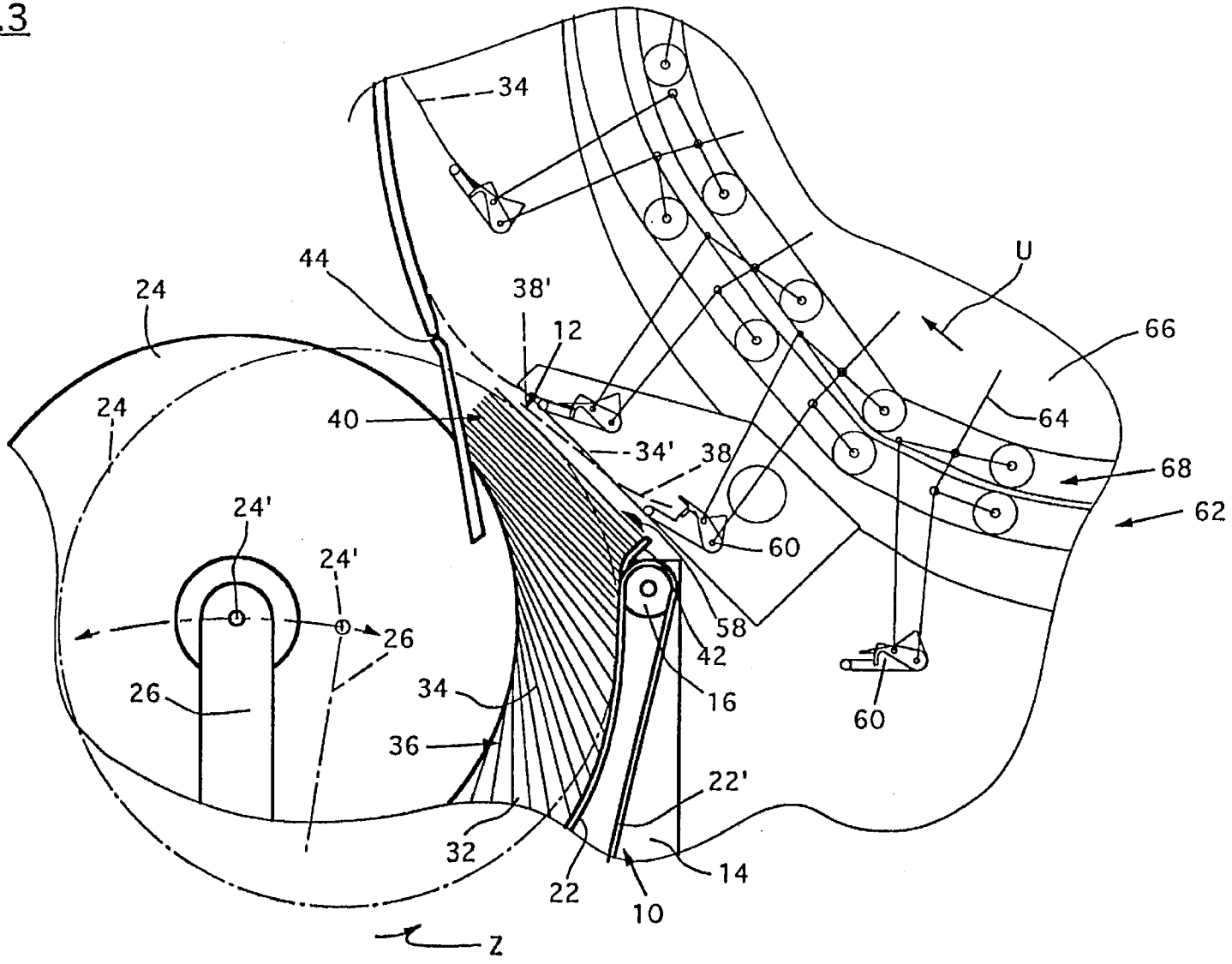
FIG. 3 shows, in elevation, a region of the apparatus, shown in FIGS. 1 and 2, at the discharge location and of a conveying device.

In FIGS. 1 and 3, 58 represents a suction head which seizes the uppermost product of the part-stack 40 at a point adjacent to the now bottom, trailing edge 38 and raises it in the direction of the arrow A. The trailing edge 38 of the product projects into the movement path of the clamps 60 of a conveying device 62. The clamp jaw of a clamp 60 is directed forwards in the direction of rotation U, and seizes the product 34 in the region of the trailing edge 38 and pushes it off the part-stack 40 (as is shown in broken lines). The clamps 60 are arranged on extension arms 64 of a rotationally driven wheel 66. The clamps 60 are controlled by a slotted-guide control 68. A conveying device 62 which is particularly suitable for this purpose is disclosed in the contemporaneously filed U.S. patent application No.08/409,792 filed Mar. 23, 1995. A similar conveying device which is also suitable for the present purpose is disclosed in EP-A-0 606 550. It is, however, also contemplated that the conveying device 62 include individually controllable grippers which are arranged, for example, on a circulating chain and seize and transport away in each case one product. For a more detailed description reference is made to U.S. Pat. No. 5,337,967 which corresponds to EP-A-0 553 455, which discloses a particularly suitable drive device for the suction head 58.

It is possible to dispense with the supporting element 42. In this arrangement, the uppermost product of the part-stack 40, which includes a small number of products in this case, is also supported on the conveying belt 10, in the region of the deflection roller 16. In this arrangement, preferably the discharge location 12 is disposed at a location at which the uppermost product 34' is arranged with its bottom edge 38 at the highest point of the conveying belt 10.

An arrangement is also contemplated wherein the removal element 44 is eliminated. This arrangement is contemplated particularly if the deflection roller 16 is located approximately at the same level as, or at a lower level than, the rotational spindle 24'.

If there are no products 34 in the conveying gap 32, the deflection wheel 24 assumes the position shown in chain-dotted lines. It can be seen that the first products 34 of the formation 36 form a wedge shape which, with the conveying belt 10 in the driven state, can readily run into the conveying gap 32. Consequently, at one end, the compliant conveying belt 10 yields in a radially outward manner with respect to the deflection wheel 24. The deflection wheel 24 is displaced back counter to the force of the spring element 28 as soon as the formation 36 runs into the rising region of the conveying gap 32. Automatic adaptation of the conveying belt 10 and of the position of the deflection wheel 24 to the formation 36 is thus achieved. At the outlet-side end of the conveying gap 32, the leading edge 38' of the products 34 runs, onto the removal element 44 and are thus raised off the deflection wheel 24. At the same time the trailing edge 38 of the products runs onto the supporting element 42 in order to form the part-stack 40. As soon as the first product 34' has reached the sensor element 46, the stepping motor 18 is stopped until the product 34' has been raised and transported away. Then, by once again setting the stepping motor 18 into operation, the formation 36 is immediately readjusted. The result is that a product 34 is always ready for discharge at the discharge location 12.

Thus, with an apparatus according to the invention, a large number of products 34, which are different with respect to both format and type, can be processed. Their overlapping is dependent on the thickness of the products, but is usually more than 90%, and preferably more than 95%. It should, however, be noted that the overlapping may also be considerably smaller.

The compliant conveying belt 10 may consist of a material with elastic properties, but it may also be replaced by a non-expansible one, which is then to be arranged in a compliant manner. For this purpose, the further deflection roller 30, for example, can be resiliently suspended.

The conveying belt 10 or the strap conveyor 52 may also be fed from a reel in which the products 34 are wound up in imbricated formation together with a winding band on a winding core. In this arrangement, the overlapping of the products is increased, preferably when transferring the products onto the conveying belt and/or the strap conveyor.

The foregoing description of the preferred embodiments of the present invention has been presented for purposes of illustration and description. The preferred embodiments are not intended to be exhaustive or to limit the invention to the precise forms disclosed, and obviously many modifications and variations are possible in light of the above teachings. It is intended that the scope of the invention be defined by the following claims, including all equivalents.

We claim:

1. An apparatus for the feeding of sheet-like products to a discharge location, the apparatus comprising:

an endless conveyor belt, the endless conveyor belt having a beginning region and a conveying and load-bearing strand, the beginning region of the conveyor belt receiving the sheet-like products in a feed direction and in imbricated formation such that the products are supported on the conveyor belt on their trailing edges;

a deflection wheel;

the conveyor belt guided, at least approximately at the discharge location, around a stationary deflection roller such that the conveying and load-bearing strand loops around the bottom of the deflection wheel, the highest point of the deflection wheel is located at a higher level than the deflection roller, deflection means movably supporting said deflection wheel for applying a prestressing force to prestress said deflection wheel in the approximate direction towards the deflection roller and enable said deflection wheel to be forced back, against said prestressing force, a conveying gap being defined by the deflection wheel and the conveyor belt; and a drive connected to move the conveyor belt such that the products are conveyed from the beginning region and fed through the conveying gap to the discharge location.

2. The apparatus as claimed in claim 1, wherein the products in the imbricated formation are arranged such that the products are almost completely overlapping.

3. The apparatus as claimed in claim 1, wherein a rotational axis of the deflection wheel is located approximately at the same level as an axis of the deflection roller.

4. The apparatus as claimed in claim 3 comprising a supporting element arranged at the discharge location and against which the products which are leaving the conveyor belt come into abutment with their trailing edge to form an oblique stack part with products butting congruently against one another.

5. The apparatus as claimed in claim 4, wherein the deflection means comprises a spring-loaded lever which is mounted beneath the conveying and load-bearing strand.

6. The apparatus as claimed in claim 5, comprising a removal element mounted downstream of the conveying gap, as seen in the feed direction, such that the removal element forms an obtuse angle with the periphery of the deflection wheel and is spaced apart from one of the deflection wheel and the supporting element by a distance which is smaller than the product length.

7. The apparatus as claimed in claim 6 wherein the drive includes a stepping motor.

8. The apparatus as claimed in claim 7 wherein provided upstream of the conveyor belt is a strap conveyor above which there is arranged a shaft which is inclined rearwards with respect to the feed direction and receives a stack of products.

9. The apparatus as claimed in claim 1, comprising a supporting element arranged at the discharge location and against which the products which are leaving the conveyor belt come into abutment with their trailing edge to form an oblique stack part with products butting congruently against one another.

10. The apparatus as claimed in claim 9 comprising a removal element mounted downstream of the conveying gap, as seen in the conveying direction, such that the removal element forms an obtuse angle with the periphery of the deflection wheel and the supporting element and is spaced apart from one of the deflection wheel and the supporting element by a distance which is smaller than the product length.

11. The apparatus as claimed in claim 1, wherein the deflection means comprises a spring-loaded lever which is mounted beneath the conveying and load-bearing strand.

12. The apparatus as claimed in claim 1 comprising a removal element mounted downstream of the conveying gap, as seen in the feed direction, such that the removal element forms an obtuse angle with the periphery of the deflection wheel and is spaced apart from the deflection wheel by a distance which is smaller than the product length.

13. The apparatus as claimed in claim 1 wherein the drive includes a stepping motor.

14. The apparatus as claimed in claim 1 wherein provided upstream of the conveyor belt is a strap conveyor above which there is arranged a shaft which is inclined rearwards with respect to the feed direction and receives a stack of products.

15. A device for the feeding of sheet-like products to a discharge location and for feeding sheet-like products to a further-processing location, the apparatus comprising:

an endless conveyor belt, the endless conveyor belt having a beginning region and a conveying and load-bearing strand, the beginning region of the conveyor belt receiving the sheet-like products in imbricated formation such that the products are supported on the conveyor belt on their trailing edges;

a movably mounted deflection wheel;

the conveyor belt guided, at least approximately at the discharge location, around a stationary deflection roller such that the conveying and load-bearing strand loops around the bottom of the deflection wheel, the highest point of the deflection wheel is located at a higher level than the deflection roller, a deflection wheel support the deflection wheel being pressed approximately in the direction towards the deflection roller, by said deflection wheel support and capable of being forced away from said deflection roller by said sheet-like products, a conveying gap being defined by the deflection wheel and the conveyor belt;

a drive connected to move the conveyor belt such that the products are conveyed from the beginning region and fed through the conveying gap to the discharge location;

a conveying device provided downstream of said discharge location, the conveying device receiving and transporting the products further; and a sucker arrangement raising a product located at the discharge location and feeding the product into a conveying region of the conveying device.

* * * * *

UNITED STATES PATENT AND TRADEMARK OFFICE

CERTIFICATE OF CORRECTION

PATENT NO. : 5,636,832

DATED : June 10, 1997

INVENTOR(S) : Werner Honegger et al.

It is certified that error appears in the above-indentified patent and that said Letters Patent is hereby corrected as shown below:

In claim 15, line 16, after "support" insert --,-- (comma).

Signed and Sealed this

Sixteenth Day of November, 1999

*Attest:*

*Attesting Officer*

Q. TODD DICKINSON

*Acting Commissioner of Patents and Trademarks*